US007657202B2

(12) United States Patent
Taki et al.

(10) Patent No.: US 7,657,202 B2
(45) Date of Patent: Feb. 2, 2010

(54) IMAGE FORMING APPARATUS AND IMAGE FORMING SYSTEM

(75) Inventors: Kenji Taki, Fuchu (JP); Chikatsu Suzuki, Hachioji (JP); Fusako Akimoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 160 days.

(21) Appl. No.: 11/812,897

(22) Filed: Jun. 22, 2007

(65) Prior Publication Data

US 2008/0002999 A1 Jan. 3, 2008

(30) Foreign Application Priority Data

Jul. 3, 2006 (JP) ..... 2006-183792
May 9, 2007 (JP) ..... 2007-124410

(51) Int. Cl.
*G03G 21/20* (2006.01)
*G03G 15/00* (2006.01)

(52) U.S. Cl. ..... 399/97; 399/44; 399/369; 399/91

(58) Field of Classification Search ..... 399/97, 399/44, 91, 94, 369
See application file for complete search history.

(56) References Cited

U.S. PATENT DOCUMENTS 5,600,427 A * 2/1997 Watanabe et al. ..... 399/97
5,930,558 A * 7/1999 Raus et al. ..... 399/97
6,771,916 B2 * 8/2004 Hoffman et al. ..... 399/92
6,823,151 B2 * 11/2004 Carlson et al. ..... 399/92
2002/0140974 A1 * 10/2002 Imaizumi et al. ..... 358/1.15
2005/0275863 A1 * 12/2005 Ota ..... 358/1.13
2008/0003000 A1 * 1/2008 Taki et al. ..... 399/44

FOREIGN PATENT DOCUMENTS

JP 2003-280461 10/2003

OTHER PUBLICATIONS

U.S. Appl. No. 11/812,898.*

* cited by examiner

*Primary Examiner*—David M Gray
*Assistant Examiner*—Rodney Bonnette
(74) *Attorney, Agent, or Firm*—Finnegan, Henderson, Farabow, Garrett & Dunner, L.L.P.

(57) ABSTRACT

An image forming apparatus, including an image forming section which forms image on a recording sheet based on image data, plural trays which accommodate the sheets to be supplied to the image forming section, a humidity detecting unit which detects humidity inside the paper tray, a dehumidifying device which dehumidify inside the paper tray, and a control section which controls the dehumidifying device and management of jobs, and controls the image forming section to execute the jobs, wherein if the humidity inside the paper tray to be used for a first priority job is higher than a predetermined value, the control section suspends execution of the first priority job, and the control section controls the image forming section to execute a reserved job which is executable from among reserved jobs with low priority order, before executing the first priority job.

12 Claims, 10 Drawing Sheets

IMAGE FORMING APPARATUS AND IMAGE FORMING SYSTEM

This application is based on Japanese Patent Application Nos. JP2006-183792 filed on Jul. 3, 2006, and JP2007-124410 filed on May 9, 2007, with the Japanese Patent Office, the entire content of both are hereby incorporated by reference.

TECHNICAL FIELD

The present invention relates to an image forming apparatus, such as a copy machine, a printer, and a compound machine, and an image forming system, and in particular, to an image forming apparatus in which humidity can be controlled.

BACKGROUND OF THE INVENTION

In an image forming apparatus, such as a copy machine, a printer, and a compound machine, based on image data which is read by a document reading device, a toner image is formed on an image carrier provided in the image forming apparatus, and after the toner image is transferred onto a recording sheet supplied from a tray, the toner image is fixed, whereby permanent image formation (or printing) is performed.

Since various types of sheets are used for printing, a coated sheet is characterized in that its air permeability is relatively low due to its coated surface, further, under a high humidity environment, moisture tends to be trapped between adjacent stacked coated sheets. Accordingly, adhesion force tends to be high between the stacked sheets, and a top coated sheet is not easily separated from a second stacked coated sheet on the tray, whereby the coated sheets are not easily supplied to the apparatus, resulting in erratic sheet feeding. Still further, when the recording sheet is conveyed under said high humidity, and printing is conducted on the sheet, paper sheet debris generated from the recording sheets accumulates in the conveyance path, interfering with proper operation of optical sensors mounted in the conveyance path to detect the recording sheets. To overcome these problems, an image forming apparatus is proposed in which a dehumidifying heater is mounted within each tray to decrease the humidity of the coated sheets.

When plural jobs are executed based on a predetermined procedure on the image forming apparatus, these jobs are required to be effectively executed. After a switch is turned on, or during an electrical power saving condition in which temperature of a fixing device is controlled to be lower, it takes a long time until the temperature of the fixing device reaches a printable condition so that waiting time is essential while no printing is executed. Since a tray to supply the sheets or a special sheet type of printing sheet is instructed for the specific job, some sheet types require low fixing temperature. In such case, a job to be operated by low fixing temperature is firstly conducted, so that the waiting time, which starts immediately after the switch is turned on, can be reduced whereby the printing operation is more effectively conducted, which is disclosed in the Unexamined Japanese Patent Application Publication No. 2003-280, 461.

However when humidity control is conducted in the paper tray as described above, if a tray incorporating a dehumidifying heater is used, a relatively long time is necessary from the activation of the image forming apparatus or from the start of dehumidification to the completion of the dehumidification. In the conventional art, the image forming apparatus conducts various jobs in a sequential order of the entrance of the printing instructions. When the image forming apparatus forms the images on the coated sheets which tend to be influenced by humidity, time for dehumidification is required for the coated sheet, so that waiting time becomes long, which results in undesirable printing efficiency. The image forming apparatus of the above patent document tries to increase the productivity rate, while using the difference of fixing temperature due to the sheet type, but it does not overcome the undesirable waiting time during the dehumidification of the sheets, which causes a major problem.

SUMMARY OF THE INVENTION

The present invention has been achieved to overcome the above problem. An object of the present invention is to provide an image forming apparatus and an image forming system which can stably conduct image formation with high productivity and high quality, even when dehumidification waiting time of the printing sheets is necessary under high humidity environment.

The object of the present invention will be attained by the structure described below.

An image forming apparatus, including:

an image forming section which forms an image on a sheet based on an image data;

plural trays which accommodate the sheets to be supplied to the image forming section, a humidity detecting unit which detects the humidity inside the paper tray, a dehumidifying device which dehumidify the inside of the paper tray, and a control section which controls the dehumidifying device and the management of jobs, and controls the image forming apparatus to execute the jobs, wherein if the humidity inside the paper tray is higher than a predetermined value, the control section controls the dehumidifying device to dehumidify the inside of the paper tray, and if the humidity inside the paper tray to be used for a first priority job is higher than the predetermined value, the control section suspends the execution of the first priority job, and the control section controls the image forming section to execute a reserved job which is executable from among reserved jobs with lower priority, before conducting the first priority job.

Based on the present invention, if the humidity inside the paper tray to be used for the first priority job is higher than the predetermined value, the lower priority job can be conducted before the first priority job is executed, so that even when a preceding job requires waiting time for humidification, another job can be immediately executed, which does not need the undesired waiting time, and thus increases the productivity of image formation of that printing apparatus.

Concerning the targeted effects of the present invention, under high humidity environments, though the waiting time is required for dehumidification of the recording sheets, the image forming apparatus and the image forming system can be designed which can conduct image formation exhibiting the high quality, with improved productivity, and without receiving the influence of humidity.

DETAILED DESCRIPTION OF THE INVENTION

An embodiment of the present invention will now be detailed, while referring to FIGS. 1-11.

Figure 1:
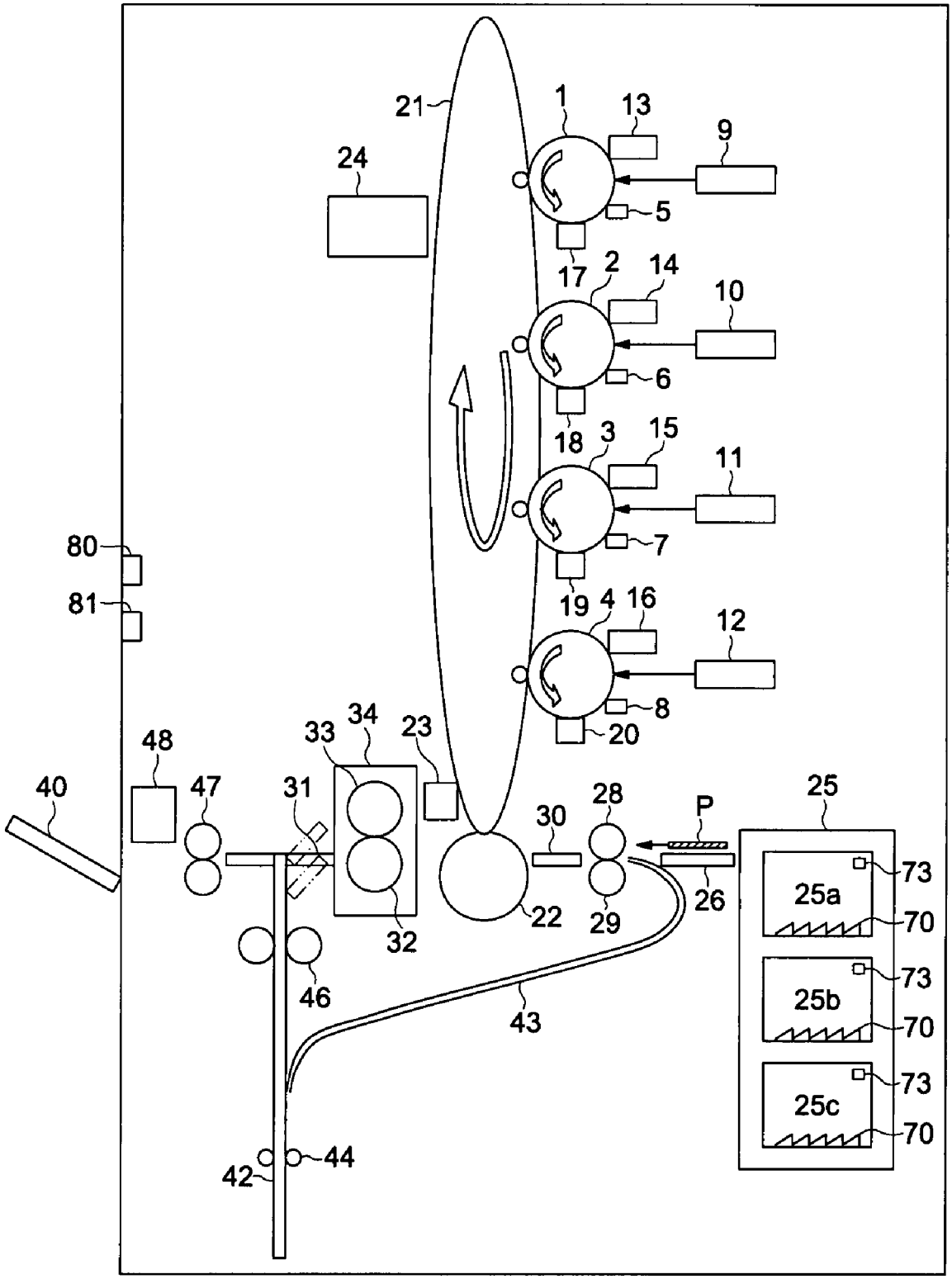
FIG. 1 is a schematic view showing a mechanical structure of an image forming apparatus of an embodiment of the present invention.

FIG. 1 is a schematic view showing a mechanical structure of the interior of the image forming apparatus, of the present invention.

The image forming apparatus incorporates charging devices 5-8 provided for four colors (which are Y, M, C and K), exposure sections 9-12 which form latent images of four colors, and dual component developing devices 13-16 provided for four colors, around photo conductors 1-4 provided for four colors, which rotate in arrowed directions. Further the image forming apparatus incorporates intermediate transfer body 21 which sequentially transfers the latent images, formed on image carriers 1-4, and transfer roller 22 which transfers the images formed on intermediate transfer body 21 onto a recording sheet which will be detailed later. Still further, in adjacent to intermediate transfer body 21, separation section 23 and cleaning device 24 are mounted, both of which exist on the downstream of transfer roller 22 with respect to the rotation direction of intermediate transfer body 21. Control section 103 having CPU, ROM and RAM, controls output timings, output values and output polarities of these loads.

Figure 3:
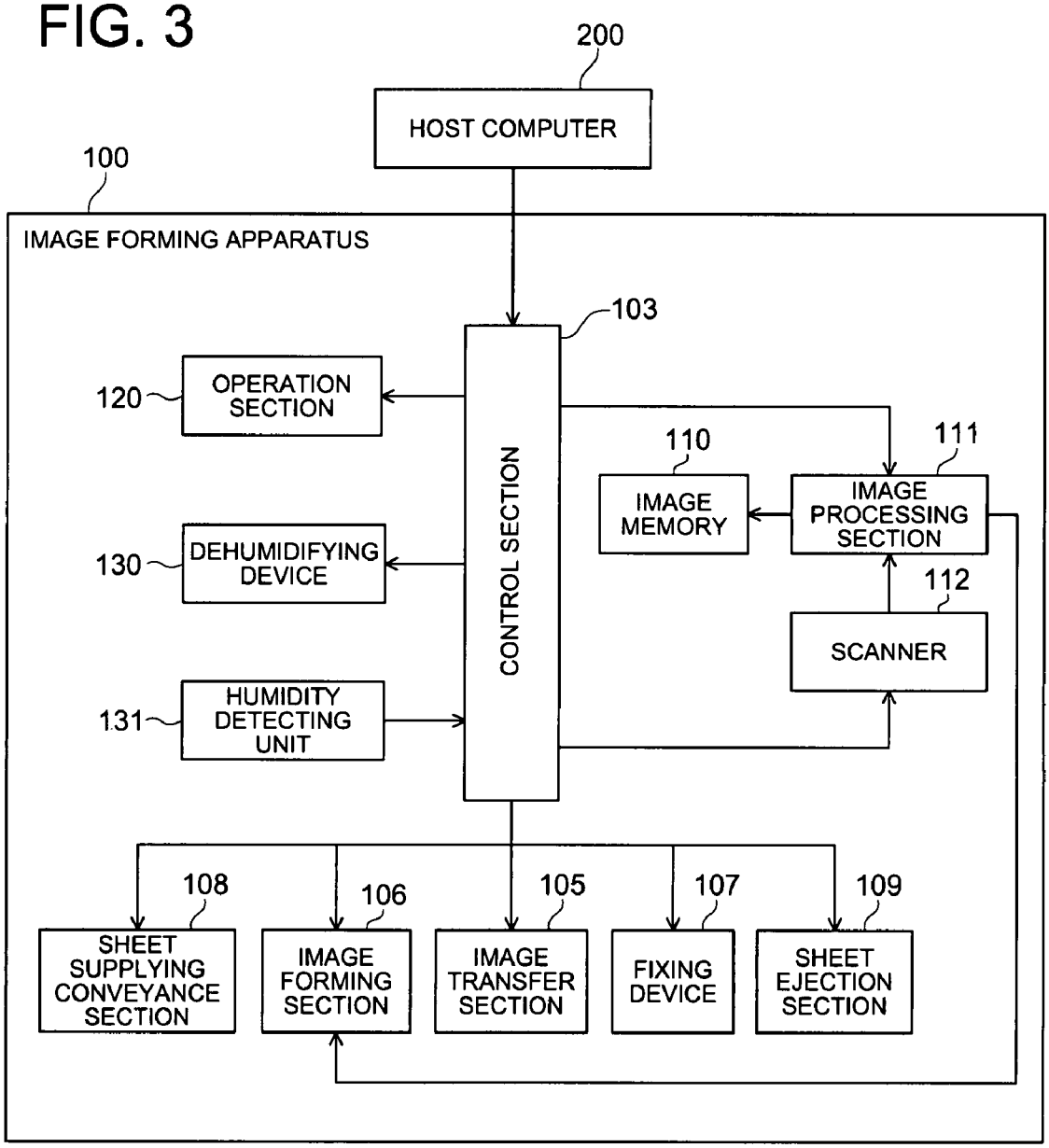
FIG. 3 is a block diagram showing a functional structure of the image forming apparatus of the present invention.

Still further, image forming section 106, shown in FIG. 3, is formed of above-described photo conductors 1-4, charging devices 5-8, exposure sections 9-12, and developing devices 13-16. Further, the transfer section 105, also shown in FIG. 3, is formed of transfer rollers 21 and 22.

Still further, in the image forming apparatus, sheet supply section 25 is provided, which includes plural trays 25*a*-25*c* to accommodate the sheets. Three trays are illustrated in FIG. 3, but the present invention does not limit the number of trays, that is, a single tray can be used, or a tray which can accommodate a large number of sheets can be used.

Figure 2:
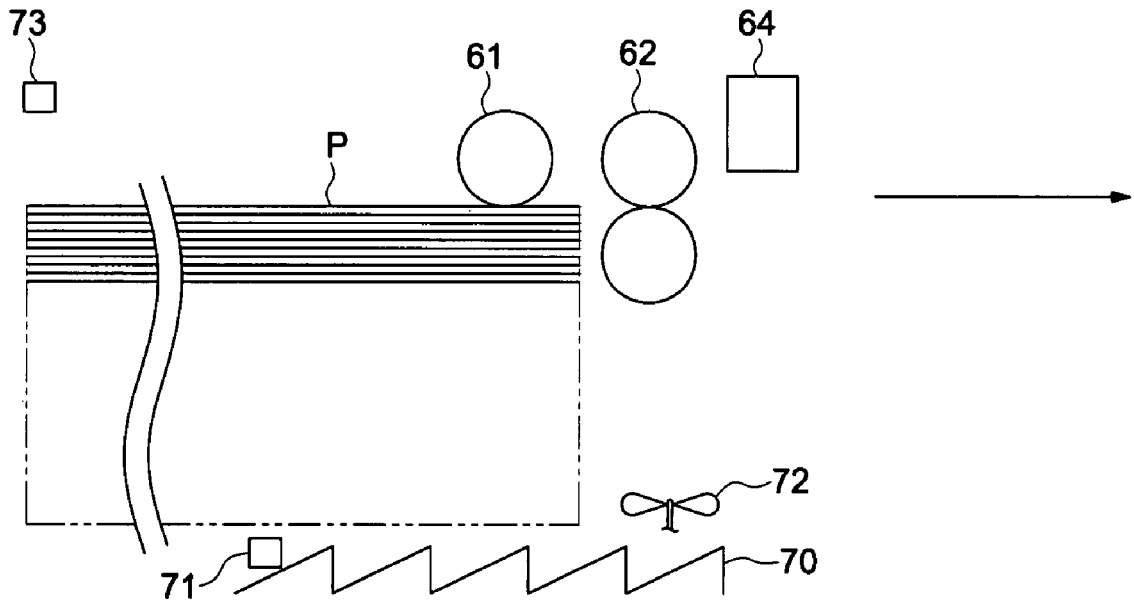
FIG. 2 is a schematic view showing the interior of a sheet supplying tray of the present invention.

In FIG. 2, the sheets to be supplied are accommodated in each of trays 25*a*-25*c*. Above each roller, separating roller 61 is mounted, which is vertically driven by a solenoid, but which is not illustrated. Paired feed-out rollers 62 are mounted to receive sheet P separated by separating roller 61, and optical sensor 64 is mounted at the downstream of paired feed-out rollers 62, which detects the top of sheet P. Further, in trays 25*a*-25*c*, dehumidifying heater 70 is mounted, which serves as the dehumidifying device to dehumidify the inside of the tray. In order to judge the humidity by the indirect detection of the humidity inside the tray, temperature sensor 73 is mounted, which detects the temperature in the tray. Still further, the image forming apparatus incorporates external humidity sensor 80 which detects the humidity outside the apparatus, and external temperature sensor 81 which detects the temperature outside the apparatus, both of which are illustrated in FIG. 1. A humidity detecting unit to detect the humidity inside the tray is structured of temperature sensor 73 to detect the temperature in the tray, external humidity sensor 80, external temperature sensor 81, and a detecting program stored in the control section.

In FIG. 1, sheet P supplied from one of trays 25*a*-25*c* is conveyed through a conveyance path having guide plate 26. Registration rollers 28 and 29, which adjust the position of sheet P, are mounted on the conveyance path. Transfer section 105, which includes guide plate 30 and transfer roller 22, is positioned at the downstream of registration rollers 28 and 29.

Sheet supplying conveyance section 108 in FIG. 3 is structured of the conveyance path which includes trays 25*a*-25*c*, separation roller 61, paired feed-out rollers 62, guide plates 26 and 30, and registration rollers 28 and 29.

Fixing device 34, which includes pressure roller 32 and heat roller 33, is mounted at the downstream of transfer section 105. Gate 31, which switches a conveyance path, is mounted at the downstream of fixing device 34. Sheet reversing path 42 is provided as the conveyance path to be switched by gate 31. Paired reversing ejection rollers 46 and paired reversing rollers 44 which is downstream of paired reversing ejection rollers 46 are mounted on sheet reversing path 42. Double sided sheet path 43 is mounted in the feed-out direction of paired reversing rollers 44. The top of double sided sheet path 43 positions at an entrance side of registration rollers 28 and 29. Gate 31, sheet reversing path 42, paired reversing rollers 44 and double sided sheet path 43 structure a portion of sheet supplying conveyance section 108.

Paired sheet ejection rollers 47 is mounted straight downstream of gate 31, and further downstream, sheet ejection sensor 48 and sheet ejection tray 40 are mounted. Sheet ejection section 109 shown in FIG. 3 is structured of gate 31, paired sheet ejection rollers 47, sheet ejection sensor 48 and sheet ejection tray 40.

Next, operation of the above-described mechanical structure is detailed.

In the image forming operation, photo conductors 1-4 are driven by motors which are not illustrated, and the surfaces of photo conductors 1-4 are electrically charged by charging devices 5-8 which are activated by a power source which is not illustrated, after which the image data is written on the surfaces by laser beams emitted from exposure sections 9-12, whereby electrostatic latent images are formed on the surfaces of photo conductors 1-4. The formed electrostatic latent images are reversely developed by developing biases generated by developing devices 13-16, whereby the images become visible as toner images on the surfaces of photo conductors 1-4. After which the toner images are transferred onto intermediate transfer body 21, which is primary transfer. Remaining toner on photo conductors 1-4 after the primary transfer is removed by cleaning sections 17-20.

On the other hand, sheet P is fed out from trays 25*a*-25*c* one by one, and is guided by guide plate 26 to registration rollers 28 and 29. In trays 25*a*-25*c*, separating roller 61 rotates on stacked sheets P to separate only top sheet P from stacked sheets P, and separated top sheet P is conveyed toward paired rollers 62. However, when the coated sheets are used as sheets P, the coated surface of the coated sheet has low air permeability. When environment is high humidity, moisture is maintained between the coated sheets, due to this, contacting force between the coated sheets increases, and the top sheet of the stacked coated sheets cannot be separated from the second sheet on the tray, whereby the sheet cannot be supplied, resulting sheet jam. Therefore, in order to reduce the humidity, dehumidifying heater 70, temperature sensor 71 for dehumidifying heater 70, dehumidifying fan 72 and temperature sensor 73 for the inside of tray are mounted on the tray.

Dehumidifying heater 70 is, for example, continuously controlled to 70° C., while temperature sensor 71 measures temperature at a position adjacent to heater 70. In the image forming apparatus of the present invention, the temperature inside the tray is controlled to be higher than the temperature outside the apparatus so that the dehumidify is conducted. In order to maintain the temperature inside the tray at the predetermined temperature, control section 103 checks the output value of temperature sensor 73 inside the tray, and activates dehumidifying fan 72 until the temperature inside the tray reaches predetermined value, and thereby heated air generated by dehumidifying heater 70 is sent inside the tray, and when the temperature inside the tray reaches the predetermined temperature, dehumidifying fan 72 is stopped.

Sheet P, supplied from any one of trays 25*a*-24*c*, is corrected by registration rollers 28 and 29 with respect to irregularity of the top of sheet P, after which sheet P is synchronously conveyed to transfer roller 22 at timing when the toner image on intermediate transfer body 21 just exactly meets an image position. Sheet P, conveyed by registration rollers 28 and 29 is guided by guide plate 30, and is conveyed to a transfer nipping section structured of intermediate transfer body 21 and transfer roller 22. Bias voltage of inverse polarity to the toner is applied to transfer roller 22, and due to the forth of static electricity, the toner image on intermediate transfer body 21 is secondarily transferred onto sheet P. Sheet P, carrying the toner image, is electrically neutralized by eliminating section 23, and is separated from intermediate transfer body 21, after which sheet P is conveyed to fixing device 34 incorporating heat roller 33 and pressure roller 32. In a case of single-sided printing, sheet P, carrying the image heat-fixed by fixing device 34, is ejected onto external sheet ejection tray 40 through gate 31 and paired sheet ejection rollers 47.

In a case of double-sided printing, sheet P is switched by gate 31 to be conveyed to sheet reversing path 42, whereby sheet P is reversed by paired reversing rollers 44, and is re-conveyed to registration rollers 28 and 29 through double sided sheet path 43, after sheet P is corrected by registration rollers 28 and 29 with respect to irregularity of the top of sheet P, sheet P is ejected onto external sheet ejection tray 40, in the same manner as in single-sided printing. Further, after the surface of intermediate transfer body 21 passes through the nipping section, the surface is cleaned by cleaning section 24 so that any remaining toner on the surface is removed, and image formation is repeated in the same way as described above.

Next, the functional structure of the image forming apparatus of the present invention is detailed while referring to the block diagram of FIG. 3. Image forming apparatus 100 includes a printing function and a copying function. When the printing function is active, after control section 103 receives printing instructions from host computer 200, control section 103 sends image processing instructions to image processing section 111, and simultaneously sends print starting instructions to image forming section 106. Control section 103 is formed of a CPU, ROM storing the control programs, and a nonvolatile memory section, such as a flash memory, which is not illustrated, to store various setting information, and a RAM temporarily storing data.

Further, control section 103 gives the plural jobs a priority order for printing, and manages them. The priority order of the jobs is stored in a RAM provided in control section 103. Further control section 103 manages the jobs and changes their order based on predetermined conditions. For example, while referring to the dehumidifying condition and to the necessity of dehumidifying control of the paper trays which are instructed for each job, or which trays are to be used based on the sheet type, control section 103 changes the priority of execution of the jobs so that the waiting time for dehumidification becomes shorter.

After receiving the image processing instructions, image processing section 111 conducts an imaging process on the image data sent from host computer 200, then image memory 110, structured of RAM or HDD, stores the processed data. Image processing section 111 is structured of CPU and ROM having the control programs.

As described above, from host computer 200, control section 103 receives a printing instruction in which a single job is typically structured of plural pages.

On the other hand, when the copying function is active, the user presses a copy button on operation section 120, then the printing instruction is sent to control section 103, and control section 103 outputs image processing instructions to image processing section 111, scan start instructions to scanner 112, and print start instructions to image forming section 106, respectively. Upon receiving the scan start instructions, scanner 112 controls a CCD image scanner and a document exposure lamp to enable scanning of the document. Further, upon receipt of the image processing instructions, image processing section 111 memorizes the image data, produced by scanner 112, in image memory 110.

In this case, if plural jobs exist, control section 103 accepts the jobs in the order as the printing instructions have been entered, and then control section 103 attaches the priority order to the jobs, based on the accepted order, and manages them. In addition, the jobs to be controlled by control section 103 can be obtained from various sections, being not limited to a specific section, for example, the jobs can be obtained from scanner 112 as well as host computer 200.

While not yet receiving a job to execute, when control section 103 initially receives a job, control section 103 controls the job as a waiting job for the moment, and when the job has a predetermined condition, control section 103 sets the job to be an execution job, so that control section 103 controls image forming section 106 to conduct the printing operation. "To set the job to be an execution job" means that control section 103 outputs an execution instruction for the waiting job or the reserved job to image forming section 106, and control section 103 transfers the image data of the job, and controls image forming section 106 based on the image forming conditions of the job. Further, when control section 103 receives the waiting job, control section 103 controls said waiting job to be an execution job as a first priority order. After receiving the waiting job, or while setting the waiting job to be the execution job to execute, if control section 103 receives another job, said other job is registered to be a reserved job. Said reserved job is executed after the waiting job has been completely executed. Accordingly, the priority order of the above reserved job is controlled as a second priority. Still further, though the reserved job as a second priority is not yet executed, if further job is entered, which is registered to be a reserved job of a third priority order which will be executed after the second one. In the same way, based on the order of the received jobs, control section 103 assigns the priority order to each job, and executes the jobs based on the assigned priority.

Still further, whichever function, is active being either the printing function and the copying function, upon receipt of the print start instructions, image forming section 106 receives the image data from image memory 110 through image processing section 111, and starts to conduct image formation to produce toner image, after which it instructs sheet supplying conveyance section 108 to feed sheet P toward registration rollers 28 and 29, where sheet P is temporarily stopped, after which sheet P is again conveyed so as to exactly meet the toner image arriving at transfer roller 22, the toner image is then transferred onto sheet P by transfer section 105. After fixing device 107 permanently fixes the toner image onto sheet P by heating and pressing between the nip of heat roller 33 and pressure roller 32, sheet P is ejected outside the apparatus by sheet ejection section 109, which has paired sheet ejection rollers 47 and sheet ejection sensor 48.

Humidity detecting unit 131 is structured of temperature sensor 73, which is mounted in each tray of sheet supplying conveyance section 108 and detects the temperature inside the respective tray, external humidity sensor 80, which is mounted outside the apparatus, and external temperature sensor 81 which is mounted outside the apparatus. The results detected by these sensors are sent to control section 103. Dehumidifying device 130 is structured of dehumidifying heater 70, temperature sensor 71 used for dehumidifying heater 70, and dehumidifying fan 72, which is controlled by control section 103. Control section 103 controls dehumidifying device 130 to dehumidify the inside of the tray, based on the humidity data detected by respective humidity detecting unit 131, accordingly dehumidifying device 130 is mounted in each tray of sheet supplying conveyance section 108. For the dehumidifying operation, a targeted humidity is established as a predetermined value, but in the present embodiment, the temperature inside the tray is practically the target parameter of the control, not the humidity inside the tray. That is, based on the detected external humidity and the external temperature, the temperature inside the tray is controlled to be the targeted temperature, whereby dehumidification of the inside of the tray is performed. When the temperature inside the tray is higher than the targeted temperature, control section 103 determines that the humidity is to be maintained to be equal to or lower than the predetermined value. Further, after the external humidity is related to the external temperature, the targeted temperature to be converted to the predetermined value concerning the humidity is stored in the non-volatile memory section, such as flash memory, in control section 103. That is, the targeted temperature inside the tray is determined as described below. Control section 103 controls dehumidifying heater at 70° C., and activates or deactivates dehumidifying fan 72 so that air heated by dehumidifying heater 70 is sent inside the tray or is not sent, whereby the temperature inside the tray is maintained to be equal to or lower than the targeted temperature.

Additionally, the humidity detecting unit can be formed of an indirect method as described above, or formed of a direct method in which a humidity sensor is installed inside each tray.

When external humidity is lower than 56%, dehumidifying heater 70 and dehumidifying fan 72 are not activated.

When external humidity is between 56%-60%, the targeted temperature is equal to (external temperature+6° C.), When external humidity is between 61%-65%, the targeted temperature is equal to (external temperature+7° C.), When external humidity is between 66%-70%, the targeted temperature is equal to (external temperature+8° C.), When external humidity is between 71%-75%, the targeted temperature is equal to (external temperature+9° C.), and When external humidity is higher than 75%, the targeted temperature is equal to (external temperature+10° C.), wherein when the external humidity is equal to or higher than 56%, dehumidifying heater 70 is activated to be 70° C.±10° C.

Figure 7:
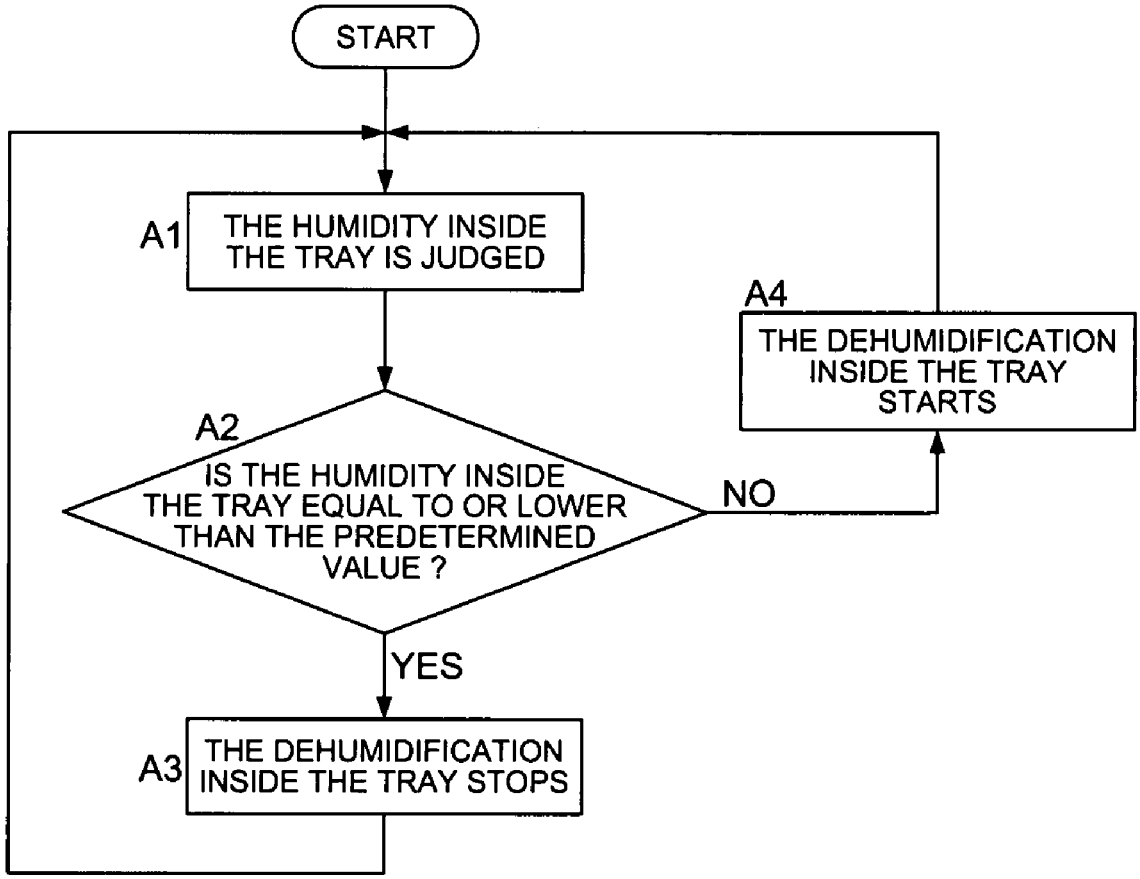
FIG. 7 of the present invention is a flow chart for dehumidifying inside the printing sheet supplying tray.
Figure 8:
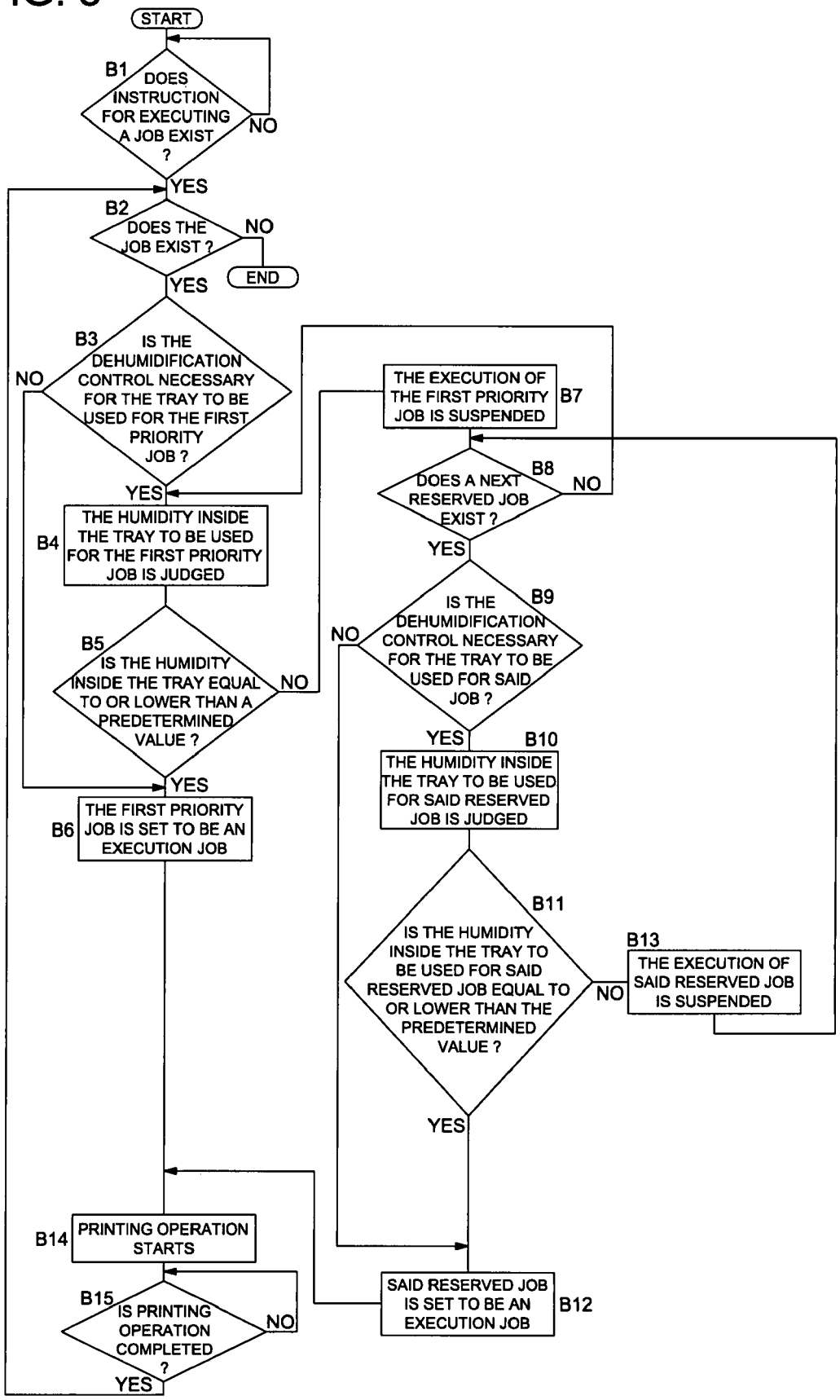
FIG. 8 of the present invention is a flow chart of the procedure for changing a conducting order of the jobs based on the humidity inside the paper tray.

The dehumidification control of the present invention will be detailed while referring to the flow chart of FIG. 7.

Control section 103 judges the humidity inside the paper tray which is to be dehumidified, based on detected results sent from the humidity detecting unit (step A1). Control section 103 judges whether the humidity inside the paper tray is equal to or lower than a predetermined value (step A2). If it is higher than the predetermined value (No in step A2), control section 103 controls dehumidifying device 130 to start dehumidification of the inside of the paper tray (step A4). During the dehumidification, if the humidity inside the paper tray is judged to be equal to or lower than the predetermined value (Yes in step A2), control section 103 stops the dehumidification of the inside of the paper tray (step A3). Accordingly, the humidity inside the paper tray is maintained to be equal to or lower than the predetermined value.

Further, when control section 103 controls dehumidifying device 130, control section 103 calculates the estimated time interval when the temperature of any predetermined tray reaches the predetermined value. In the present embodiment, the estimated time interval when the temperature inside the tray reaches the targeted temperature is determined by a simple expression shown below.

estimated time interval (minute)=[targeted temperature (° C.)−temperature inside the tray (° C.)]/(° C./minute)

Further, a predetermined time interval, serving as a base to change control, has been set in control section 103, when control section 103 is activated based on the above estimated time. For example, a time interval of 5 minutes can be set as an initial value, and said set value can be stored in the non-volatile memory section, such as the flash memory in control section 103. Additionally, the predetermined value can be changed by operation section 120, and said changed predetermined value can also be stored in memory section 103.

In addition, control section 103 can timely conduct the humidity adjustment inside the paper tray, that is, when the image forming apparatus is electrically activated, or the execution instruction of the jobs is entered, it can be conducted. Further, when sheets which need dehumidification, such as coated sheets, is instructed to be used, humidity adjustment can be conducted.

Control section 103 receives the humidity conditions inside each tray, and determines whether or not the humidity inside each tray is equal to or lower than the predetermined value. When the humidity of any one of the trays is equal to or lower than the predetermined value, control section 103 executes image formation, while when it is greater than the predetermined value, control section 103 inhibits image formation.

Figure 4:
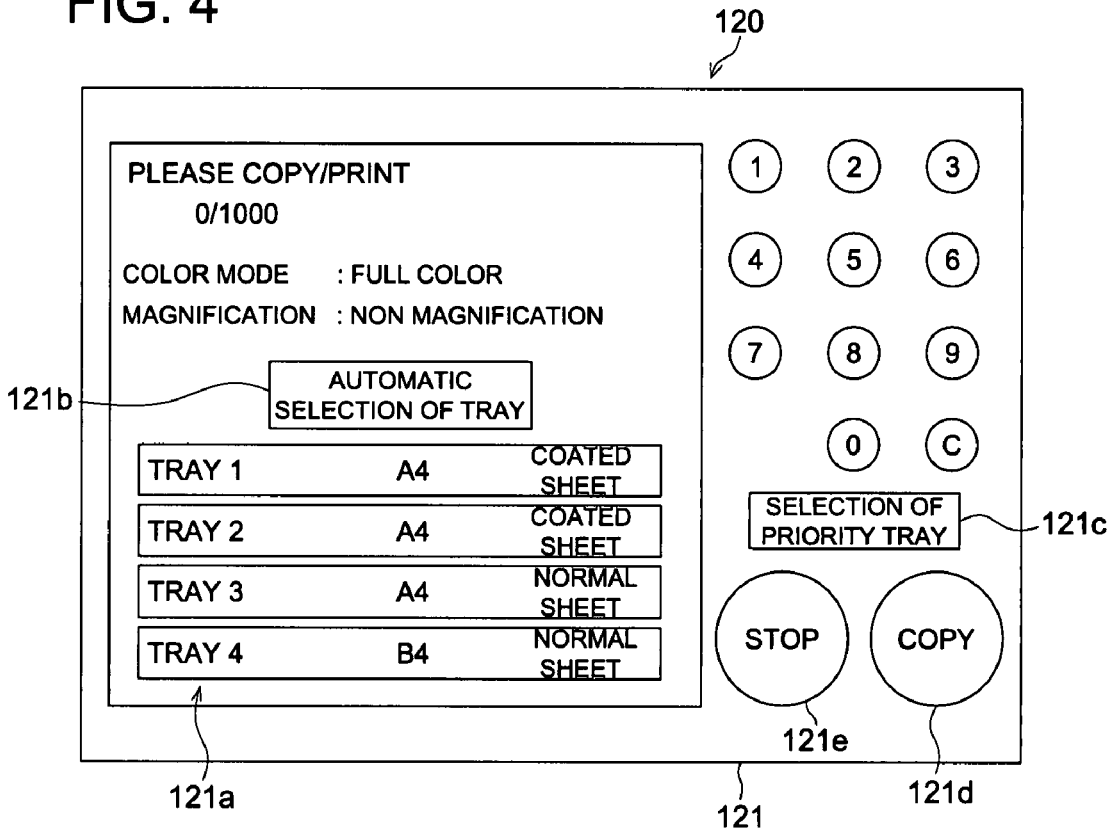
FIG. 4 shows an operational section of the present invention, on which a normal operation screen is displayed.

Image forming apparatus 100 incorporates operation section 120, which is structured of a touch panel, for example, and which displays various information and by which the operator inputs various settings. Operation section 120 is controlled by control section 103. Inputted information through operation section 120 is sent to control section 103. FIGS. 4-7 show the structures of operation section 120, which is mounted at an appropriate position on image forming apparatus 100 to be operated by the operator. In the present embodiment, operation section 120 is structured of a touch display and plural buttons. FIG. 4 shows the user operation screen 121 in a normal condition as a copy/print mode. In this screen, four trays are prepared on stages, and on tray display section 121*a*, the size and type of the sheets accommodated in the tray on each stage are shown. When the user touches "automatic tray selection" button 121*b* by each touch, an automatic tray selection function is changed between an effective condition and a no-effective condition. The automatic tray selection function means a function in which a tray to be used for supplying the sheets is automatically selected among the plural trays, based on predetermined rules. In this example, for serving as a copier of the document, a tray is selected which accommodates sheets whose size is the same as the size of the document, and from which the sheets are supplied. For serving as a printer, image size information is selected from received image data, and a tray is selected which accommodates the sheets whose size is the same as said selected information, and from which the sheets are supplied. Said automatic tray selection function is obtained by the operation of control section 103.

When the automatic tray selection function is used, "automatic tray selection" of button 121*b* is displayed, while the text color is reversed from black to white, or vise versa, and a tray is selected in the order of descending priority, which will be detailed later, the selected tray is then displayed while the text color is reversed. When the automatic tray selection function is not used, "automatic tray selection" of button 121*b* is returned to the normal display, the user touches a desired tray number so that the touched one is displayed, while the text color is reversed, whereby the selection of the tray is completed.

Further, the user can replace the accommodated sheets in each tray so that the sheet type is changed, but it is necessary for the user to set the changed sheet type accommodated in the tray.

Figure 5:
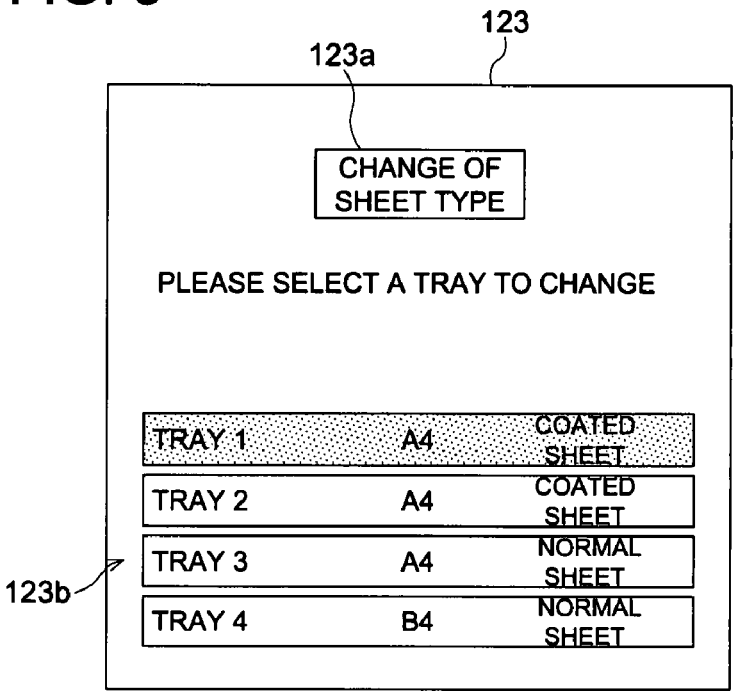
FIG. 5 shows an operational section of the present invention, on which a screen for setting the printing sheet type is displayed.

Via sheet type changing screen 123, shown in FIG. 5, the user can change the sheet type of the sheets accommodated in the tray. The user can change the display from the setting menu screen to the sheet type changing screen 123, while it is being displayed on operation section 120. When the user selects a tray to be changed, from among tray selecting column 123*b* on sheet type changing screen 123, sheet type selecting screen 124 is displayed. Additionally, when the user presses sheet type changing button 123*a* on sheet type changing screen 123, the screen returns to the preceding screen, such as a setting menu screen, showing the changed setting.

Figure 6:
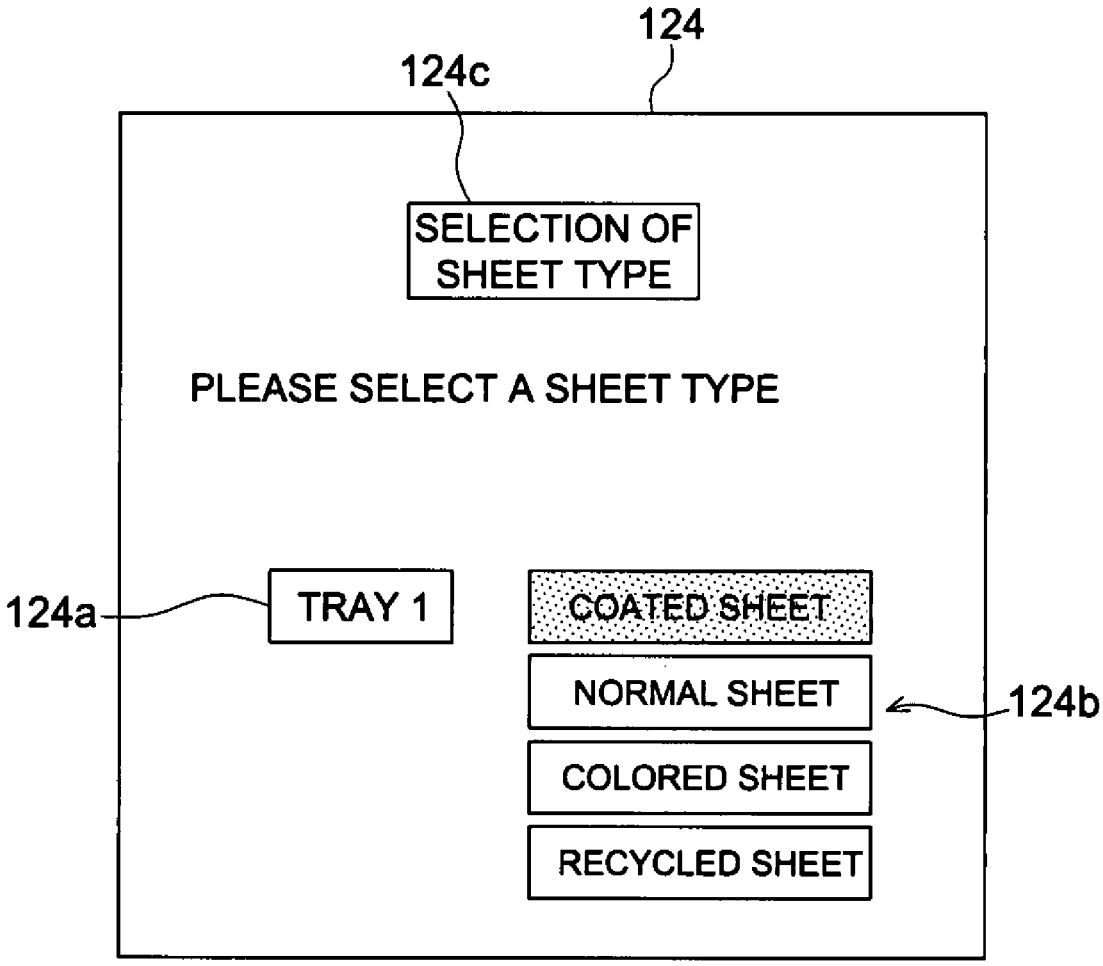
FIG. 6 shows an operational section of the present invention, on which a screen for changing the type of printing sheet is displayed.

On sheet type selecting screen 124 shown in FIG. 6, the tray selected on the previous screen is displayed on tray display column 124*a*, while selectable sheet types are displayed on sheet type list column 124*b*. When the user presses a desired button, among the plural sheet type buttons displayed on sheet type list column 124*b*, said button is displayed while the text color is reversed from the normal. After the user selects a sheet type, the user presses sheet type selecting button 124*c*, the screen returns to the previous screen, showing the selected sheet type in the tray.

Additionally, information of the type of sheet set in a specific tray is stored in a flash memory provided in control section 103.

Next, the control procedure will be detailed in accordance with the humidity inside each tray. After control section 103 receives jobs, including the image data produced in host computer 200 or scanner 112, control section 103 stores the jobs in image memory 110, and adds an order number to each job for control. In addition, each job includes image forming conditions in which the paper tray used for image formation and the type of sheet to be used are instructed, which are shown below.

binding position: upper section, left section or right section stapling: none, at one point, or at two points punching: none, two punches, or three punches sheet ejection tray: master tray, or sub-tray type of sheet: coated sheet, or normal sheet size of sheet: A4 size, or B5 size Firstly, a typical case of a job will be detailed while referring to the flow chart of FIG. 8. Control section 103 awaits a job execution instruction (step B1), if it is entered (Yes in step B1), control section 103 judges whether a job to be executed exists (step B2). If no job exists, the flow is completed (No in step B2). If a job to be executed exists (Yes in step B2), control section 103 judges whether the paper tray to be used for the first priority job needs to be dehumidified (step B3). If the paper tray to be used for the first priority job does not need to be dehumidified (No in step B3), control section 103 sets the job of the first priority to be an execution job (step B6). If the paper tray to be used for the first priority job needs to be dehumidified (Yes in step B3), control section 103 judges the humidity inside the paper tray to be used for the first priority (step B4). Further, control section 103 judges whether the humidity inside the paper tray is equal to or lower than a predetermined value (step B5). If it is Yes in step B5, control section 103 sets the job of the first priority to be an execution job (step B6). On the other hand, if the humidity inside the paper tray is higher than the predetermined value (No in step B5), control section 103 suspends the execution of the job of the first priority (step B7), and judges whether any reserved job, such as a reserved job of the second priority, exists (step B8). If no reserved job exists (No in step B8), control section 103 returns the procedure to step B4, and repeats the judging procedures of steps B4-B7. When the paper tray to be used for the first priority job is completely dehumidified (Yes in step B5), the job of the first priority is set as an execution job. If the reserved job exists (Yes in step B8), control section 103 judges whether the paper tray to be used for said reserved job needs to be dehumidified (step B9). If the paper tray to be used for said reserved job does not need to be dehumidified (No in step B9), control section 103 sets said reserved job to be an execution job (step B12). If the paper tray to be used for said reserved job needs to be dehumidified (Yes in step B9), control section 103 judges the humidity inside the paper tray to be used for said reserved job (step B10). Further, control section 103 judges whether the humidity inside the paper tray is equal to or lower than the predetermined value (step B11). If it is Yes in step B11, control section 103 sets said reserved job to be an execution job (step B12). On the other hand, if the humidity inside said tray is higher than the predetermined value (No in step B11), control section 103 suspends the execution of said reserved job (step B13). Still further, control section 103 returns the procedure to step B8, and repeats the same steps as above for a next reserved job. The jobs, which were set to be the execution jobs in step B6 or step B12, are then executed by control section 103, that is, image formation is executed based on each job (step B14). When image formation is completed (Yes in step B15), control section 103 returns to step B2, to judge whether a next job to be executed exists, and repeats the same steps as above. When no job to be executed exists (No in step B2), control section 103 stops the operational flow.

Based on the control procedure conducted by control section 103, the reserved job is executed based not on only the priority of the job, but if a tray exists which holds the suitable humidity for the reserved job, the reserved job is then executed, so that the waiting time for the dehumidification can be shortened, and thereby the productivity of image formation is improved.

Additionally, in the above procedure, for a tray to be used for a job, the judging condition is whether the humidity inside the paper tray is equal to or lower than the predetermined value. If the humidity inside the paper tray is higher than the predetermined value, and if the estimated duration until the completion of dehumidification is relatively shorter, it is possible to conduct the jobs based on the previously set priority, without changing the executing order of the jobs.

Figure 9:
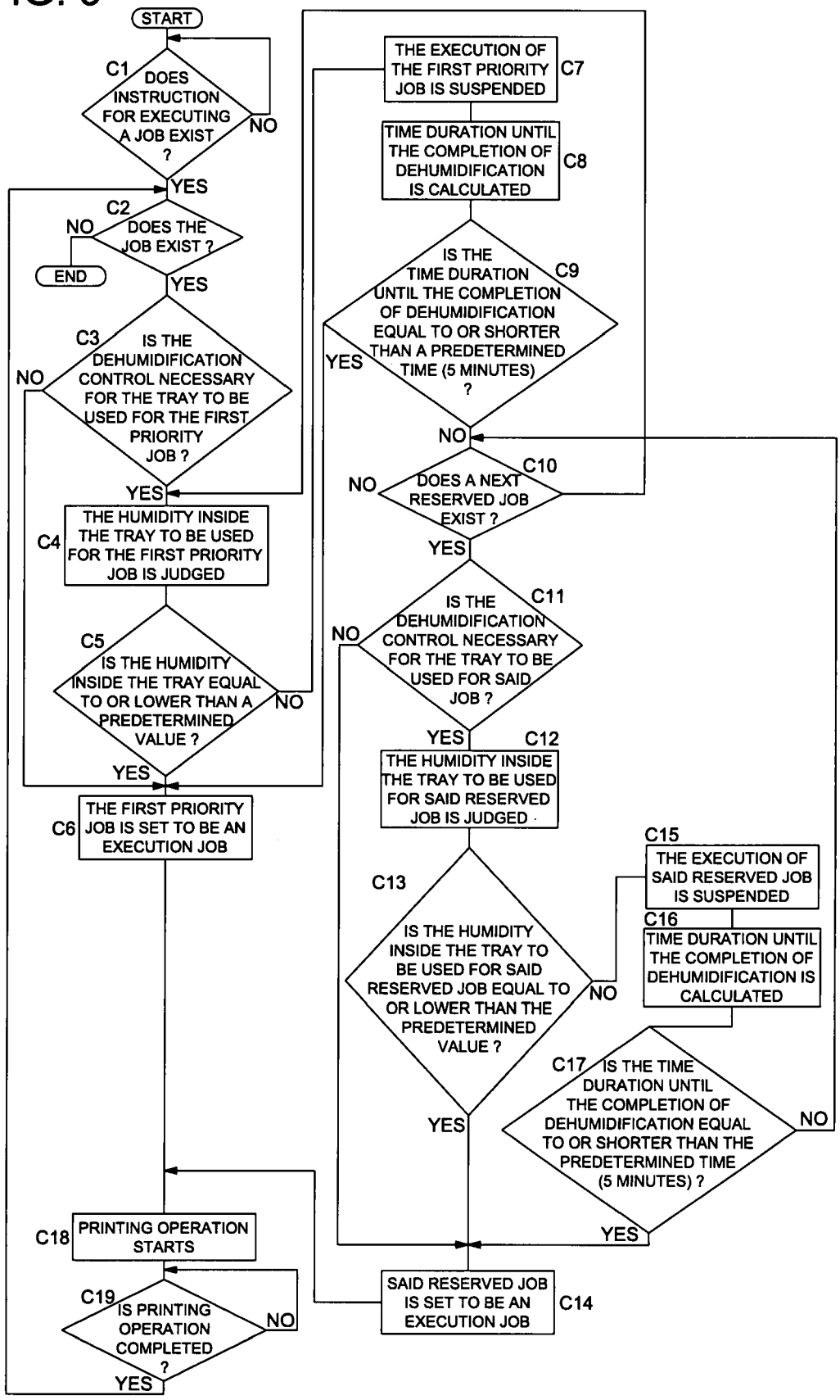
FIG. 9 of the present invention is a flow chart of the procedure for changing the conducting order of the jobs, based on the estimated duration until dehumidification is completed.

The above control procedure will be detailed based on the flow chart of FIG. 9. Control section 103 awaits job execution instructions (step C1), when the job execution instruction is entered (Yes in step C1), control section 103 judges whether a job to be executed already exists (step C2). If no job to be executed exists, control section 103 stops the operational flow (No in step C2). If a job to be executed already exists (Yes in step C2), control section 103 judges whether the paper tray to be used for the first priority job needs to be dehumidified (step C3). If the paper tray to be used for the first priority job does not need to be dehumidified (No in step C3), control section 103 sets the job of the first priority to be an execution job (step C6). On the other hand, if the paper tray to be used for the first priority job needs to be dehumidified (Yes in step C3), control section 103 judges the humidity inside the paper tray to be used for the first priority (step C4). Further, control section 103 judges whether the humidity inside the paper tray is equal to or lower than a predetermined value (step C5). If it is Yes in step C5, control section 103 sets the job of the first priority to be an execution job (step C6). On the other hand, if the humidity inside the paper tray is higher than the predetermined value (No in step C5), control section 103 suspends the execution of the job of the first priority (step C7), and calculates an estimated time interval until the completion of dehumidification of the paper tray to be used for the first priority job (step C8). After which, control section judges whether the estimated time interval until the completion of dehumidification is equal to or shorter than a predetermined time interval, for example 5 minutes (step C9). If the estimated time interval is equal to or shorter than the predetermined time interval (Yes in step C9), control section 103 sets said first priority job as an execution job (step C6). If the estimated time interval is longer than the predetermined time interval (No in step C9), control section 103 judges whether a next reserved job exists to be executed, such as a second priority job (step C10). If no next reserved job exists (No in step C10), control section 103 returns the procedure to step C4, and repeats the judging procedures of steps C4-C9. On the other hand if the next reserved job exists (Yes in step C10), control section 103 judges whether the paper tray to be used for said reserved job needs to be dehumidified (step C1). If the paper tray to be used for said reserved job does not need to be dehumidified (No in step C11), control section 103 sets said reserved job to be an execution job (step C14). If the paper tray to be used for said reserved job needs to be dehumidified (Yes in step C11), control section 103 judges the humidity inside the paper tray to be used for said reserved job (step C12), and further judges whether the humidity inside the paper tray is equal to or lower than the predetermined value (step C13). If the humidity is equal to or lower than the predetermined value (Yes in step C13), control section 103 set the job to be an execution job (step C14). On the other hand, if the humidity is higher than the predetermined value (No in step C13), control section 103 suspends the execution of the reserved job (step C15), and calculates the estimated time until the completion of dehumidification (step C16). After which, control section judges whether the estimated time interval until the completion of dehumidification is equal to or shorter than a predetermined time interval, for example 5 minutes (step C17). If the estimated time interval is equal to or shorter than the predetermined time interval (Yes in step C17), control section 103 sets said reserved job to be an execution job (step C14). If the estimated time interval is longer than the predetermined time interval (No in step C17), control section 103 returns the procedure to step C10, and repeats the judging procedures of a next reserved job. Image formation is then conducted for the job which was set to the execution job in step C6 or C14 (step C18). When image formation is completed, that is, when the job has been executed (Yes in step C19). Control section 103 returns the procedure to step C2, and again judges whether a reserved job exists to be executed, and performs the same procedure as the above, and when the reserved job has been completely executed (No in step C2), control section 103 stops the operational flow.

In addition, the above estimated time can be judged more correctly by studying not only the present humidity inside the paper tray but also the temperature characteristics of each tray. The temperature characteristics are based on the volume of the tray, the remaining recording sheets in the paper tray, the type of sheets, and the weight of sheets.

Based on the control procedure conducted by control section 103, if the estimated time is longer than the predetermined time, the executing order of the jobs can be changed based on the present humidity condition inside the paper tray, because production efficiency is most essential. If the estimated time is equal to or shorter than the predetermined time, the jobs are executed based on the previously instructed execution order of the jobs.

Further, if the paper trays to be used for plural jobs are in a state of high humidity, the executing order of the jobs can be changed in such a way that a job is firstly executed using a tray exhibiting the shortest estimated time until the completion of dehumidification.

Figure 10:
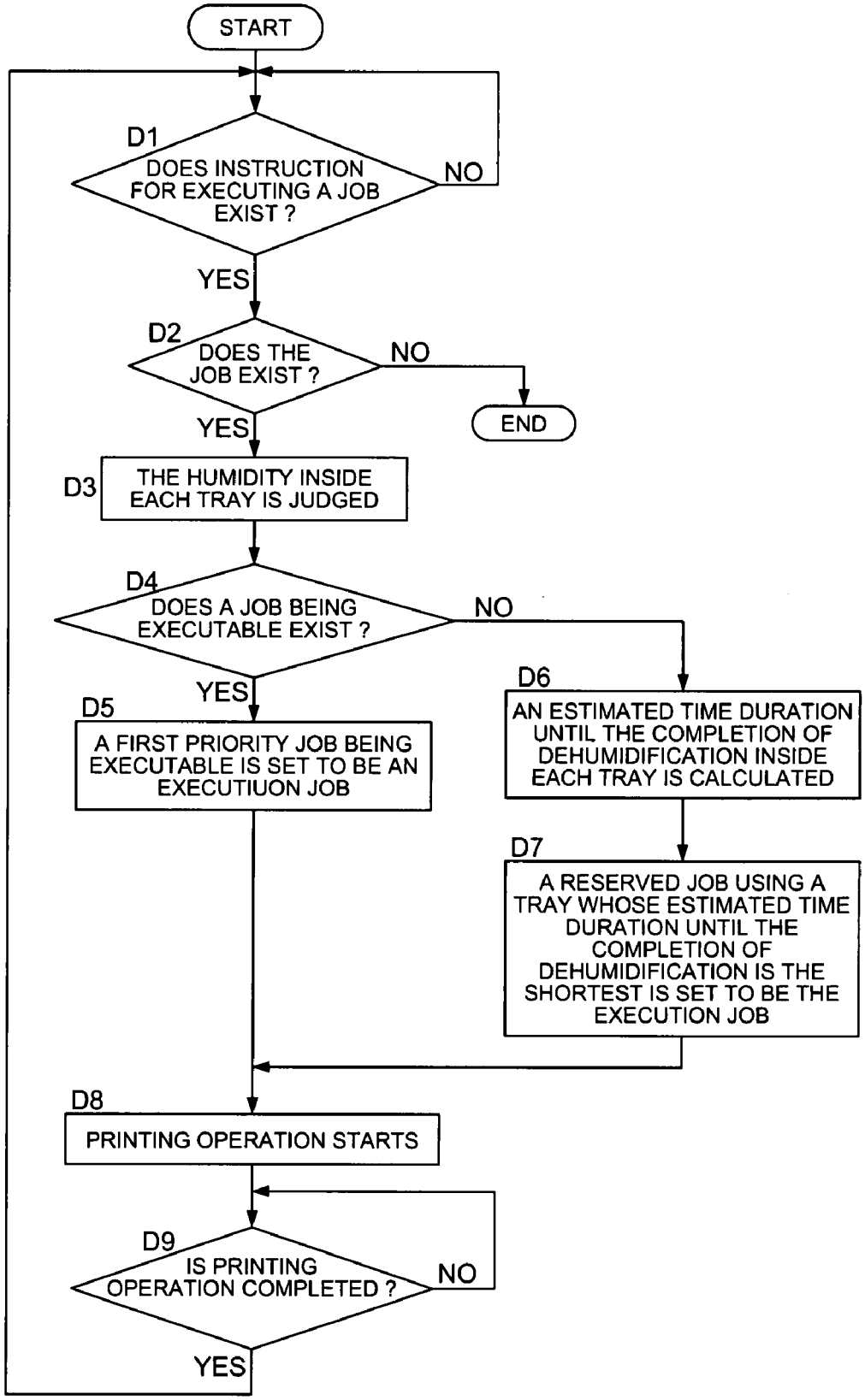
FIG. 10 of the present invention is a flow chart of the procedure for changing the conducting order of plural jobs which use the sheet tray of high humidity.

The preceding control procedure will be detailed while referring to FIG. 10. Control section 103 awaits a job execution instruction (step D1), when the job execution instruction is entered (Yes in step D1), control section 103 judges whether a job to be executed already exists (step D2). If no job to be executed exists, control section 103 stops the operational flow (No in step D2). If a job to be executed already exists (Yes in step D2), control section 103 judges the humidity inside each tray (step D3), and further judges whether any executable jobs exist among the total jobs, that is, whether a job exists which uses the paper tray exhibiting the humidity which is equal to or lower than the predetermined value, or whether a job exists which uses the paper tray which does need to be dehumidified (step D4). If an executable job exists (Yes in step D4), control section 103 sets the job of the highest priority to be an execution job, among the plural executable jobs (step D5). On the other hand, if no executable job exists (No in step D4), control section 103 calculates an estimated time until the completion of dehumidification of each tray (step D6). Next, control section 103 sets a job which uses the paper tray exhibiting the shortest dehumidification time to be an execution job, among the total jobs (step D7). The jobs, which were set to be the execution jobs in step D5 or step D7, are executed by control section 103, that is, image formation is conducted for each execution job (step D8). When image formation is completed (Yes in step D9), control section 103 returns to step D2, to judge whether a next job to be executed exists, and repeats the same steps as the above. When no job to be executed exists (No in step D2), control section 103 stops the operational flow.

In the above descriptions of the present invention, the image forming apparatus is detailed which controls the jobs and can change the executing order of any job. However, it is also possible to structure an image forming system in the present invention in which a computer serving as an external apparatus controls the jobs and changes the executing order of all jobs.

Figure 11:
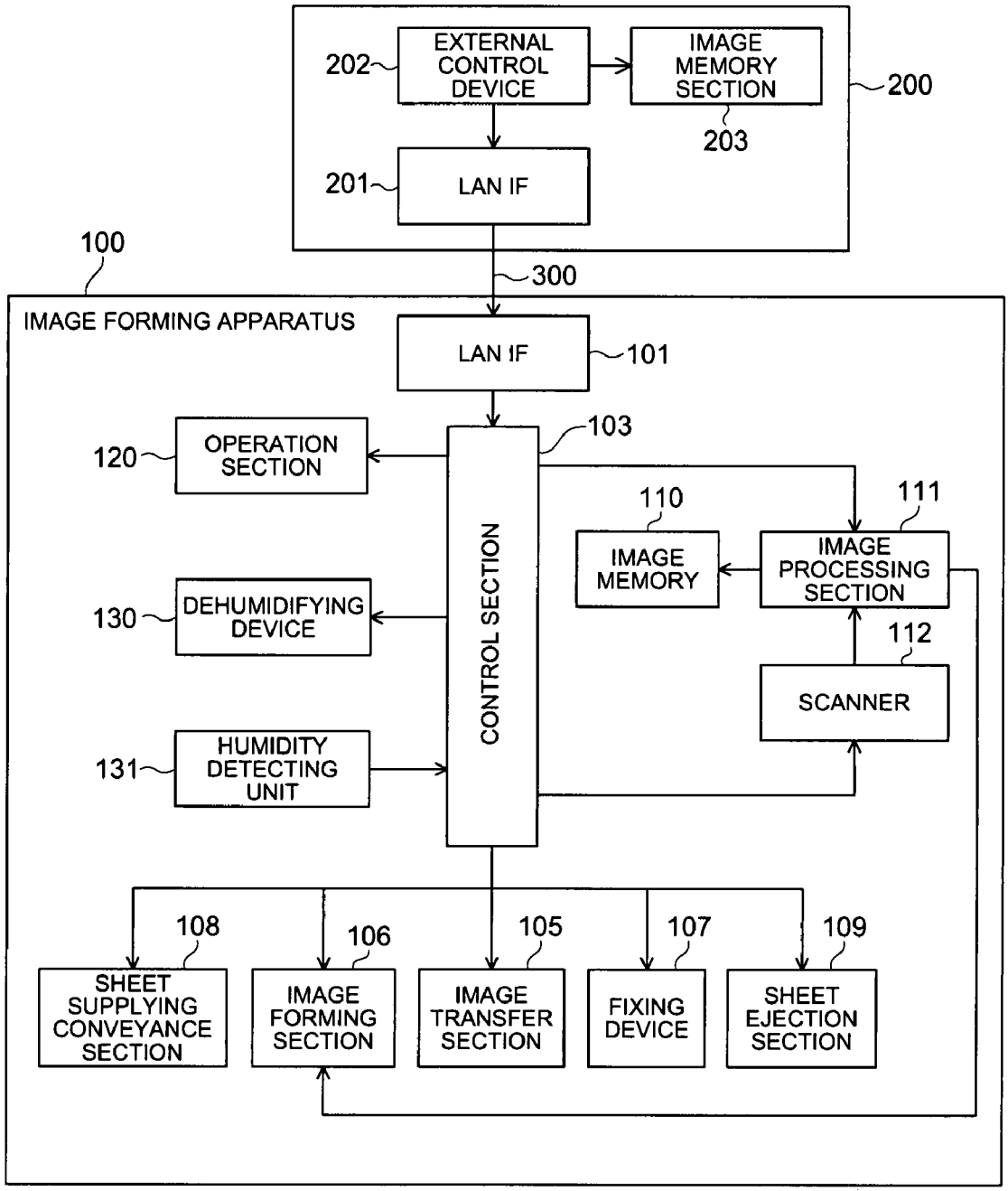
FIG. 11 is a block diagram showing a functional structure of an image forming system of an embodiment of the present invention.

The image forming system will now be detailed while referring to block chart of FIG. 11. Image forming apparatus 100 is structured in the same way as the apparatus detailed in FIG. 1, so that image forming apparatus 100 will not be detailed again.

In the present embodiment, host computer 200, serving as the external apparatus, includes external control device 202. External control device 202 is connected to LAN interface 101 of an image forming apparatus, through LAN interface 201 and LAN 300. Image memory 203 to store the jobs is connected to external control device 202. External control device 202 can send the jobs stored in image memory 203 to image forming apparatus 100 through LAN 300, and sends a printing instruction to control section 103 of image forming apparatus 100 so that the job is executed.

Further, control section 103 of image forming apparatus 100 controls the humidity inside each tray, and also controls humidity information, such as use and disuse of the humidity control. Control section 103 sends said humidity information to host computer 200 through LAN 300. External control device 202 of host computer 200 receives said humidity information through LAN interface 201.

External control device 202 is structured of a CPU and a ROM, which stores control programs, and includes a non-volatile memory section, which is not illustrated, such as a flash memory to store various setting information, and a RAM to temporarily store data. In order to allow image forming apparatus 100 to control the job and execute the job, external control device 202 controls image forming section 106 through control section 103 of image forming apparatus 100.

The control operation conducted in external control device 202 is conducted through control section 103, which is the same as the control conducted by control section 103 of image forming apparatus 100, whereby its explanation is skipped.

In the above control procedure, a job using a tray exhibiting appropriate humidity is executed by priority, so that productivity of image formation can be improved.

The present invention has been detailed based on the above embodiments, but the present invention is not limited to the contents detailed above, and which invention can be appropriately changed within the scope of this invention as long as it does not deviate from the contents of the present invention.

What is claimed is:

1. An image forming apparatus, comprising:

an image forming section which forms an image on a recording sheet based on an image data;

plural trays which accommodate the recording sheets to be supplied to the image forming section;

a humidity detecting unit which detects humidity inside the tray;

a dehumidifying device which dehumidifies inside the tray; and a control section which controls the dehumidifying device and management of jobs, and controls the image forming section to execute the jobs, wherein in a case that the humidity inside the tray to be used for a first priority job is higher than a predetermined value, the control section suspends execution of the first priority job, and the control section controls the image forming section to execute a reserved job which is executable from among reserved jobs with low priority order, before executing the first priority job.

2. The image forming apparatus of claim 1, wherein the case that the humidity inside the tray to be used for the first priority job is higher than the predetermined value further represents a case that an estimated time until the humidity inside the tray reaches the predetermined value by dehumidification conducted by the dehumidifying device is longer than a predetermined time.

3. The image forming apparatus of claim 1, wherein the reserved job which is executable represents a reserved job which uses a tray exhibiting the humidity being equal to or lower than the predetermined value or uses a tray being needless to be dehumidified.

4. The image forming apparatus of claim 3, wherein the tray exhibiting the humidity being equal to or lower than the predetermined value further represents a tray having an estimated time until the dehumidification is completed equal to or shorter than the predetermined time.

5. An image forming apparatus, comprising:

an image forming section which forms an image on a recording sheet based on image data;

plural trays which accommodate the recording sheets to be supplied to the image forming section;

a humidity detecting unit which detects humidity inside the tray;

a dehumidifying device which dehumidifies inside the tray; and a control section which controls the dehumidifying device and management of jobs, and controls the image forming section to execute the jobs, and when the humidity inside the tray is higher than a predetermined value, the control section controls the dehumidifying device to dehumidify inside the tray, wherein in a case that a job to be executable does not exist among reserved jobs, the control section controls the image forming section to execute a job which uses a tray whose estimated time until the completion of the dehumidification of the inside of the tray is the shortest among the plural trays.

6. The image forming apparatus of claim 5, wherein the case that the job to be executable does not exist among the reserved jobs represents a case that the humidity inside the trays to be used for the reserved jobs is higher than the predetermined value.

7. The image forming apparatus of claim 5, wherein if a job to be executable exists among the reserved jobs, the control section controls the image forming section to execute a job whose priority is the highest among the reserved jobs.

8. The image forming apparatus of claim 6, wherein if a job to be executable exists among the reserved jobs, the control section controls the image forming section to execute a job whose priority is the highest among the reserved jobs.

9. The image forming apparatus of claim 1, wherein if a type of the recording sheets accommodated in the tray is not a predetermined type, the control section does not conduct the dehumidification inside the tray.

10. An image forming system, comprising:

an image forming apparatus, including:

an image forming section which forms an image on a recording sheet based on image data;

plural trays which accommodate the recording sheets to be supplied to the image forming section;

a humidity detecting unit which detects humidity inside the tray;

a dehumidifying device which dehumidifies inside the tray;

a control section which controls the dehumidifying device, and controls the image forming section to execute jobs; and an external device including a control device which controls management and execution of the jobs;

wherein if the humidity inside the tray is higher than a predetermined value, the control section controls the dehumidifying device to dehumidify inside the tray, and controls the image forming section to execute the jobs, and wherein if the humidity inside the tray to be used for the job of first priority is higher than the predetermined value, the control device controls the image forming section through the control section to suspend the execution of the job of first priority and to execute a reserved job which is executable among the reserved jobs exhibiting lower priority, before the job of the first priority is executed.

11. An image forming system, comprising an image forming apparatus, including:

an image forming section which forms an image on a recording sheet based on image data;

plural trays which accommodate the recording sheets to be supplied to the image forming section;

a humidity detecting unit which detects humidity inside the tray;

a dehumidifying device which dehumidifies inside the tray;

a control section which controls the dehumidifying device, and controls the image forming section to execute jobs; and an external device including a control device which controls management and execution of the jobs;

wherein if the humidity inside the tray is higher than a predetermined value, the control section controls the dehumidifying device to dehumidify inside the tray, and further controls the image forming section to execute the jobs, and wherein if a job to be executable does not exist among reserved jobs, the control section controls the image forming section through the control section to execute a job which uses a tray whose estimated time until the completion of the dehumidification of the inside of the tray is the shortest among the plural trays.

12. An image forming system, comprising an image forming apparatus, including:

an image forming section which forms an image on a recording sheet based on image data;

plural trays which accommodate the recording sheets to be supplied to the image forming section;

a humidity detecting unit which detects humidity inside the tray;

a dehumidifying device which dehumidify dehumidifies inside the tray;

a control section which controls the dehumidifying device, and controls the image forming section to execute jobs; and an external device including a control device which controls management and execution of the jobs;

wherein if the humidity inside the tray is higher than a predetermined value, the control section controls the dehumidifying device to dehumidify inside the tray, and wherein if a job to be executable does not exist among reserved jobs, the control section controls the image forming section through the control section to execute a job which uses a tray whose estimated time until the completion of the dehumidification of the inside of the tray is the shortest among the plural trays.

* * * * *